US011486621B2

(12) United States Patent
Shang et al.

(10) Patent No.: US 11,486,621 B2
(45) Date of Patent: Nov. 1, 2022

(54) CONTROLLER AND METHOD FOR COMPRESSOR, COMPRESSOR ASSEMBLY AND REFRIGERATION SYSTEM

(71) Applicant: Danfoss (Tianjin) Ltd., Tianjin (CN)

(72) Inventors: Zhiwei Shang, Tianjin (CN); Li Yao, Tianjin (CN); He Ma, Tianjin (CN); Guocun Li, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 147 days.

(21) Appl. No.: 16/214,614

(22) Filed: Dec. 10, 2018

(65) Prior Publication Data

US 2019/0178547 A1 Jun. 13, 2019

(30) Foreign Application Priority Data

Dec. 8, 2017 (CN) ..... 201711306983.1

(51) Int. Cl.
*F25B 49/02* (2006.01)
*F25B 13/00* (2006.01)
*F25B 31/00* (2006.01)

(52) U.S. Cl.
CPC ..... *F25B 49/022* (2013.01); *F25B 13/00* (2013.01); *F25B 31/008* (2013.01); *F25B 2600/25* (2013.01); *F25B 2600/2515* (2013.01); *F25B 2700/151* (2013.01); *F25B 2700/193* (2013.01); *F25B 2700/21152* (2013.01)

(58) Field of Classification Search
CPC ..... F25B 2600/2509; F25B 31/008
See application file for complete search history.

(56) References Cited

U.S. PATENT DOCUMENTS 4,262,492 A * 4/1981 Morita ..... F25B 13/00 62/324.6
4,387,368 A * 6/1983 Day, III ..... H04M 11/04 340/517
5,076,067 A * 12/1991 Prenger ..... F04C 28/28 417/32
5,197,297 A * 3/1993 Brendel ..... F04B 39/06 62/197

(Continued)

FOREIGN PATENT DOCUMENTS

CN 2722484 Y 8/2005
CN 102261719 A 11/2011

(Continued)

OTHER PUBLICATIONS

First Examination Report for Indian Serial No. 201814046606 dated Apr. 24, 2020.

*Primary Examiner* — Nelson J Nieves
(74) *Attorney, Agent, or Firm* — McCormick, Paulding & Huber PLLC

(57) ABSTRACT

Embodiments of the disclosure provide a controller for a compressor and a control method, a compressor assembly, and a refrigeration system, which improve control efficiency and reliability. The controller includes an obtaining module configured to obtain at least one operation state parameter of the compressor, and a controlling module configured to shut off a liquid injection valve if one of the at least one operation state parameter of the compressor meets a protection action condition, wherein the liquid injection valve is configured to regulate flow of fluid injected into the compressor.

20 Claims, 4 Drawing Sheets

(56) References Cited

U.S. PATENT DOCUMENTS

| | | | | |
|---|---|---|---|---|
| 5,640,854 | A | 6/1997 | Fogt et al. | |
| 5,873,255 | A | 2/1999 | Madigan | |
| 5,946,925 | A | 9/1999 | Williams et al. | |
| 5,996,364 | A * | 12/1999 | Lifson | F04C 28/24 62/196.1 |
| 6,185,949 | B1 * | 2/2001 | Madigan | F04C 29/0014 62/222 |
| 6,324,858 | B1 * | 12/2001 | Holden | F25B 31/008 62/211 |
| 6,571,566 | B1 * | 6/2003 | Temple | F25B 49/005 62/127 |
| 6,948,336 | B2 * | 9/2005 | Fujita | C09K 5/045 252/68 |
| 7,290,398 | B2 | 11/2007 | Wallace et al. | |
| 8,539,785 | B2 * | 9/2013 | Jiang | F25B 1/10 62/217 |
| 10,018,393 | B2 * | 7/2018 | Kopko | F25B 41/00 |
| 10,088,202 | B2 * | 10/2018 | Huff | F25B 1/10 |
| 2006/0042282 | A1 * | 3/2006 | Ludwig | F25B 49/02 62/222 |
| 2007/0000261 | A1 * | 1/2007 | Flynn | F04C 29/0007 62/114 |
| 2009/0188265 | A1 * | 7/2009 | Ko | F25B 41/20 700/275 |
| 2010/0236264 | A1 * | 9/2010 | Lifson | F25B 49/005 62/115 |
| 2012/0318008 | A1 * | 12/2012 | Liu | B60H 1/3228 62/115 |
| 2014/0209288 | A1 * | 7/2014 | Simon | F25B 23/006 165/281 |
| 2015/0204589 | A1 * | 7/2015 | Liu | F25B 1/10 62/80 |
| 2015/0330692 | A1 * | 11/2015 | Kopko | F25B 1/10 62/115 |
| 2016/0370039 | A1 | 12/2016 | Kawano et al. | |
| 2017/0056289 | A1 * | 3/2017 | Tsuno | F25D 11/003 |
| 2017/0198707 | A1 * | 7/2017 | Umeda | F04D 29/582 |
| 2017/0198720 | A1 * | 7/2017 | Umeda | F04D 29/284 |
| 2018/0363954 | A1 * | 12/2018 | Zhao | F24F 11/83 |
| 2019/0113264 | A1 * | 4/2019 | Tsukiyama | F25B 1/10 |
| 2019/0154317 | A1 * | 5/2019 | Zha | F25B 40/00 |
| 2019/0203995 | A1 * | 7/2019 | Ueda | F25B 49/02 |

FOREIGN PATENT DOCUMENTS

| | | | | | |
|---|---|---|---|---|---|
| CN | 102331124 | A | | 1/2012 | |
| CN | 102575887 | A | * | 7/2012 | F25B 49/005 |
| CN | 102606481 | A | | 7/2012 | |
| CN | 202991431 | U | | 6/2013 | |
| CN | 104405629 | A | | 3/2015 | |
| CN | 104728091 | A | | 6/2015 | |
| CN | 105465962 | A | | 4/2016 | |
| CN | 105928277 | A | | 9/2016 | |
| CN | 106524548 | A | * | 3/2017 | F25B 49/005 |
| CN | 106595126 | A | | 4/2017 | |
| CN | 107294065 | A | | 10/2017 | |
| CN | 107683395 | A | * | 2/2018 | F25B 49/005 |
| JP | 2005188433 | A | | 7/2005 | |
| KR | 20020063760 | A | | 8/2002 | |
| WO | WO-8808108 | A1 | * | 10/1988 | F25B 25/005 |
| WO | 2006045143 | A1 | | 5/2006 | |
| WO | WO-2017203608 | A1 | * | 11/2017 | F25B 31/008 |

* cited by examiner

CONTROLLER AND METHOD FOR COMPRESSOR, COMPRESSOR ASSEMBLY AND REFRIGERATION SYSTEM

CROSS-REFERENCE TO RELATED APPLICATIONS

Applicant hereby claims foreign priority benefits under U.S.C. § 119 from Chinese Patent Application No. 201711306983.1 filed on Dec. 8, 2017, the content of which is incorporated by reference herein.

TECHNICAL FIELD

The present disclosure relates to compressor technologies, and in particular, to a controller and a control method for a compressor, a compressor assembly, and a refrigeration system.

BACKGROUND

As a key component in refrigeration equipment, a compressor is widely concerned with its efficiency and stability. In a typical refrigeration system, if the compressor is operated with a high discharge temperature for a long period of time, severe damage will be brought to the compressor. Therefore, the existing refrigeration equipment is normally provided with a liquid injection valve, and a liquid injection controller is configured to control an open degree of the liquid injection valve to control the flow of the fluid injected to the compressor, thereby decreasing the discharge temperature of the compressor.

However, the existing liquid injection controller normally cannot trigger an effective protection action in time when a state parameter of the compressor becomes abnormal, thus resulting in low control efficiency and unreliable control effect.

SUMMARY

Embodiments of the present disclosure provide a controller for a compressor and a control method for a compressor, a compressor assembly and a refrigeration system, which improve control efficiency and reliability.

In an aspect of the present disclosure, a controller for a compressor includes: an obtaining module configured to obtain at least one operation state parameter of the compressor; and a controlling module configured to shut off a liquid injection valve if one of the at least one operation state parameter of the compressor meets a protection action condition, wherein the liquid injection valve is configured to regulate the flow of fluid injected into the compressor.

In an embodiment, the at least one operation state parameter comprises a discharge temperature of the compressor, and the controlling module is further configured to control, if the at least one operation state parameter of the compressor does not meet the protection action condition, the liquid injection valve according to the discharge temperature of the compressor.

In an embodiment, the controlling module is configured to shut off the liquid injection valve and power off the compressor if the discharge temperature of the compressor is above a first threshold value.

In an embodiment, the controlling module is configured to adjust, if the discharge temperature of the compressor is above a second threshold value and below the first threshold value, an open degree of the liquid injection valve according to the discharge temperature of the compressor and the second threshold value.

In an embodiment, the at least one operation state parameter includes phase information of a power supply circuit of the compressor, and the controlling module is configured to shut off the liquid injection valve and power off the compressor if the power supply circuit is in a phase loss state or phase reverse state.

In an embodiment, the at least one operation state parameter includes information on whether the compressor is powered on, and the controlling module is configured to shut off the liquid injection valve if the compressor is not powered on.

In an embodiment, the controlling module is further configured to control an alarm to raise an alarm if one of the at least one operation state parameter meets the protection action condition, and/or to record the at least one operation state parameter if one of the at least one operation state parameter meets the protection action condition.

In an embodiment, the controlling module is further configured to record one or more of: a discharge temperature of the compressor, an open degree of the liquid injection valve, information on whether the compressor is powered on, whether a power supply circuit of the compressor is in a phase loss state or phase reverse state, and whether the discharge temperature exceeds a first threshold value.

In another aspect of the present disclosure, a method for controlling liquid injection for a compressor is provided. The method includes: obtaining at least one operation state parameter of the compressor; and shutting off a liquid injection valve if one of the at least one operation state parameter of the compressor meets a protection action condition, wherein the liquid injection valve is configured to regulate flow of fluid injected into the compressor.

In an embodiment, the at least one operation state parameter includes a discharge temperature of the compressor, and wherein the method further includes: controlling, if the at least one operation state parameter of the compressor does not meet the protection action condition, the liquid injection valve according to the discharge temperature of the compressor.

In an embodiment, the shutting off a liquid injection valve if one of the at least one operation state parameter of the compressor meets a protection action condition includes: shutting off the liquid injection valve and powering off the compressor if the discharge temperature of the compressor is above a first threshold value.

In an embodiment, the controlling a liquid injection valve according to the discharge temperature of the compressor if one of the at least one operation state parameter of the compressor meets a protection action condition includes: adjusting, if the discharge temperature of the compressor is above a second threshold value and below the first threshold value, an open degree of the liquid injection valve according to the discharge temperature of the compressor and the second threshold value.

In an embodiment, the at least one operation state parameter includes phase information of a power supply circuit of the compressor, and wherein the shutting off a liquid injection valve if one of the at least one operation state parameter of the compressor meets a protection action condition includes: shutting off the liquid injection valve and powering off the compressor if the power supply circuit is in a phase loss state or phase reverse state.

In an embodiment, the at least one operation state parameter includes information on whether the compressor is powered on, and wherein the shutting off a liquid injection valve if one of the at least one operation state parameter of the compressor meets a protection action condition includes: shutting off the liquid injection valve if the compressor is not powered on.

In a further aspect of the present disclosure, a compressor assembly is provided. The compressor assembly includes: a compressor; a liquid injection valve configured to regulate flow of fluid injected into the compressor; and a controller for controlling the liquid injection valve and/or the compressor according to above aspects of the disclosure.

In a yet further aspect of the present disclosure, a refrigeration system is provided. The system includes: a compressor assembly according to the above aspects of the disclosure; a condenser, an inlet of the condenser being connected to a refrigerant fluid outlet of the compressor; a throttle device, an inlet of the throttling device being connected to an outlet of the condenser; and an evaporator, an inlet of the evaporator being connected to an outlet of the throttling device, an outlet of the evaporator being connected to a refrigerant fluid inlet of the compressor.

Embodiments of the disclosure provide a controller for a compressor and a method therefor, a compressor assembly, and a refrigeration system. When one of the at least one state parameter meets the protection action condition and liquid injection need be stopped, the controller can directly and actively control the liquid injection valve to stop the liquid injection. Through actively controlling the protection action of the liquid injection valve by the controller, the liquid injection valve can be closed more reliably and efficiently or the liquid injection valve and the compressor can be off more reliably and efficiently, thereby improving the safety and operation efficiency of the entire control system. In addition, compared to the prior art which requires an additional solenoid valve to perform the protection action of the liquid injection valve, embodiments of the present disclosure omit the solenoid valve at the front end of the liquid injection valve, thereby simplifying the system structure and reducing the occupation space and product costs.

DETAILED DESCRIPTION

The technical solutions in the embodiments of the present invention are clearly and completely described in the following with reference to the accompanying drawings in the embodiments of the present invention. It is obvious that the described embodiments are only a part of the embodiments of the present invention, and not all of the embodiments. All other embodiments obtained by those skilled in the art based on the embodiments of the present invention without creative efforts are within the scope of the present invention.

Figure 1A:
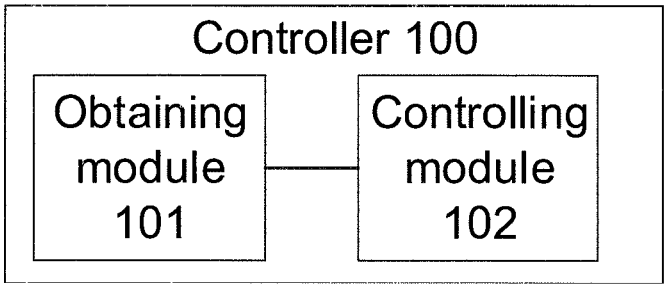
FIG. 1A is a schematic structural diagram of a controller for a compressor according to an embodiment of the present disclosure.

FIG. 1A is a schematic structural diagram of a controller for a compressor according to an embodiment of the present disclosure. As shown in FIG. 1A, a controller 100 includes an obtaining module 101 and a controlling module 102.

In particular, the obtaining module 101 is configured to obtain at least one operation state parameter of a compressor 200. The at least one operation state parameter indicates operation state of the compressor 200. The controlling module 102 is configured to determine whether one of the at least one operation state parameter of the compressor meets a protection action condition. If one of the at least one operation state parameter of the compressor meets a protection action condition, the controlling module 102 shuts off a liquid injection valve 300. The liquid injection valve 300 is connected into the injection line of the compressor 200 and is configured to regulate the flow of fluid in the injection line so as to control the discharge temperature of the compressor 200. In an embodiment of the disclosure, the controlling module 102 may be connected to the obtaining module 101 and the liquid injection valve 300, respectively, to control the liquid injection valve 300 according to operation state parameters acquired by the obtaining module 101.

Therefore, according to the controller 100, when one of the at least one state parameter acquired meets the protection action condition and liquid injection need be stopped, the controlling module 102 in the controller 100 can directly control the liquid injection valve 300 to stop the liquid injection, and the liquid injection valve can be closed or the liquid injection valve and the compressor can be closed more reliably and efficiently. The safety and operation efficiency of the entire control system is thus improved. In addition, compared to the prior art which requires an additional solenoid valve to perform the protection action for the liquid injection valve, embodiments of the present disclosure do not need the solenoid valve, thereby simplifying the system structure and reducing the occupation space and product costs.

Figure 1B:
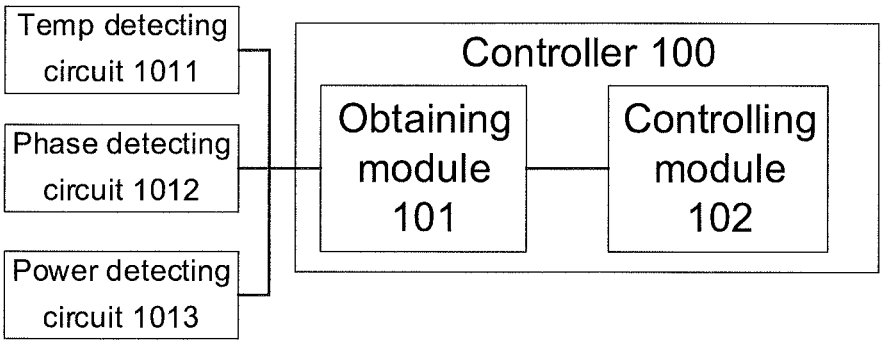
FIG. 1B is a schematic structural diagram of a controller for a compressor according to another embodiment of the present disclosure.

In an embodiment, the at least one operation state parameter may include a discharge temperature of the compressor 200. In this case, the controlling module 102 is further configured to control, if the at least one operation state parameter of the compressor does not meet the protection action condition, the liquid injection valve 300 according to the discharge temperature. As can be seen, the operation state parameter acquired by the obtaining module 101 includes the discharge temperature, and the controlling module 102 may control the liquid injection valve 300 according to the discharge temperature in the case that the protection action need not be performed. That is, the controlling module 102 has both functions of liquid injection control and protection control. In the conventional art, an additional solenoid valve is required to perform the protection action, and the protection action control is performed by a protection controller and the liquid injection control is performed by a liquid injection control. Comparatively, in the disclosure, the controlling module 102 can perform both the discharge temperature control and protection control for the compressor. Thus, the solenoid valve used in the conventional art at the front end of the liquid injection valve is not needed, and one controller is omitted. Thereby, the system structure is further simplified, and the occupation space and product costs are reduced. In an embodiment, as shown in FIG. 1B, the obtaining module 101 may obtain the discharge temperature of the compressor 200 through the temperature detecting circuit 1011.

In an embodiment, the controlling module 102 is further configured to determine whether the discharge temperature obtained by the obtaining module 101 is above a first threshold value. If the discharge temperature is above the first threshold value, it means that the discharge temperature of the compressor 200 is too high and even the liquid injection valve 300 cannot reduce the discharge temperature of the compressor 200. In order to avoid damage to the compressor 200, the controlling module 102 is configured to perform protection actions, e.g., powering off the compressor 200, to protect the compressor 200. For example, the controlling module 102 can power off the compressor 200 by controlling a contactor connected in the power supply circuit of the compressor 200. Meanwhile, in order to prevent the liquid injection valve 300 from being in a liquid injection state even if the compressor 200 is stopped, the liquid injection valve 300 is shut off. It can be seen that the controlling module 102 has the function of controlling the liquid injection valve 300 to perform the protection action (i.e., shutting off the liquid injection valve 300 to stop liquid injection) and also the function of performing protection action of the compressor 200 (i.e., powering off the compressor 200).

If the discharge temperature of the compressor 200 does not exceed the first threshold value, it means that the discharge temperature of the compressor 200 is still within a controllable range. That is, the coolant ejected from the liquid injection valve 300 can still be used to effectively control the discharge temperature of the compressor 200. In this case, the controlling module 102 is configured to adjust, if the discharge temperature of the compressor is above a second threshold value and below the first threshold value, an open degree of the liquid injection valve 300 according to the discharge temperature of the compressor and the second threshold value. It should be understood that the first threshold value is a temperature threshold value where the compressor 200 operates normally and that the second threshold value is a predefined discharge temperature where liquid injection is needed for the compressor 200. If the discharge temperature of the compressor 200 is above the first threshold value, it means that the compressor 200 cannot operate normally. If the discharge temperature of the compressor 200 is above the second threshold value and below the first threshold value, the compressor 200 may operate normally but liquid injection is needed for the compressor 200 so as to avoid the discharge temperature from being too high. However, the specific values of the first and second thresholds can be set or adjusted by a designer or an operator according to a practical scenario. The specific values of the first and second thresholds will not be limited in the present disclosure. It can be seen that the controlling module 102 has the function of a liquid injection controller, in addition to performing protection action of the compressor 200 (i.e., powering off the compressor 200) and controlling the liquid injection valve 300 to perform the protection action (i.e., shutting off the liquid injection valve 300 to stop liquid injection). It should be understood that the specific control method of the open degree of the liquid injection valve 300 can be realized by, for example, PI or PID (proportional-integral or proportional-integral-derivative controller), and the specific control implementation manner of the open degree of the liquid injection valve 300 is not limited in the present disclosure.

In an embodiment, the at least one operation state parameter may further include phase information of a power supply circuit of the compressor 200. The controlling module 102 is further configured to determine whether the power supply circuit of the compressor 200 is in a phase loss state or phase reverse state. If the power supply circuit is in a phase loss state or phase reverse state, it means that there is an error or failure in the power supply circuit of the compressor 200, and the controlling module 102 should perform protection actions to power off the compressor 200 so that the compressor 200 stops operation. Meanwhile, the liquid injection valve 300 shall be shut off so as to prevent the liquid injection valve 300 from being in the injection state even if the compressor 200 is stopped. If the power supply circuit is not in a phase loss state or phase reverse state, it means that the power supply circuit of the compressor 200 operates normally. Therefore, similar to the above embodiment, the controlling module 102 also has the function of performing protection action of the compressor 200 (i.e., powering off the compressor 200) in addition to controlling the liquid injection valve 300 to perform the protection action (i.e., shutting off the liquid injection valve 300 to stop liquid injection). The difference lies in that the protection action condition is related to whether the power supply circuit of the compressor 200 is in a phase loss state or phase reverse state. In an embodiment, as shown in FIG. 1B, the obtaining module 101 can obtain the phase information of the power supply circuit of the compressor 200 through a phase detecting circuit 1012.

In an embodiment of the present disclosure, as shown in FIG. 1B, both the discharge temperature and phase information of the compressor 200 can be used as the operation state parameter for determining whether the protection action need be performed. The obtaining module 101 includes the temperature detecting circuit 1011 and the phase detecting circuit 1012. In a further embodiment, a power supply abnormality in the compressor 200 can cause significant damage to the compressor 200 in a short time, and the discharge temperature abnormality does not affect the compressor 200 so fast, and thus the protection action performed according to the power supply abnormality has a higher priority than the protection action performed according to the discharge temperature abnormality. In other words, the controlling module 102 is configured to firstly determine whether the power supply circuit is in a phase loss state or phase reverse state according to the phase information acquired by the phase detecting circuit 1012. If the power supply circuit is in a phase loss state or phase reverse state, the liquid injection valve 300 is shut off and the compressor 200 is powered off. If the power supply circuit is not in a phase loss state or phase reverse state, it is further determined whether the discharge temperature acquired by the temperature detecting module 1011 exceeds a first threshold. If it is further determined that the discharge temperature exceeds the first threshold, the liquid injection valve 300 is shut off and the compressor 200 is powered off. In another embodiment, it is also possible to simultaneously determine whether the two operation state parameters meet the protection action condition, and the liquid injection valve 300 is shut off and the compressor 200 is powered off when one of the operation state parameters meets the protection action condition.

In an embodiment of the present disclosure, the at least one operation state parameter may further include information on whether the compressor 200 is powered on. For example, it can be determined whether the compressor 200 is powered on by determining whether the power supply circuit of the compressor 200 is powered on. The controlling module 102 is further configured to determine whether the power supply circuit of the compressor 200 is powered off according to power information acquired by the power detecting circuit 1013. If the power supply circuit is powered off, it means that the compressor 200 is not powered on and does not operate, and it may cause damage to the compressor 200 if the liquid injection valve 300 continues operating. Therefore, the controlling module 102 may shut off the liquid injection valve 300. Since the compressor 200 is inactive when it is not powered on, it is not necessary to determine whether one of the at least one operation state parameter meets the protection action condition, and thus the foregoing determination process based on the discharge temperature and phase information is no longer required. On the other hand, if the power supply circuit is powered on, it indicates that the compressor 200 is in a normal power-on state at this moment, and it is necessary to further determine whether one of the at least one operation state parameter meets the protection action condition, and the protection action is performed if one of the at least one operating state parameter meets the protection action condition. If neither of the at least one operation state parameter meets the protection action condition, the liquid injection valve 300 is controlled according to the discharge temperature. In an embodiment, as shown in FIG. 1B, the obtaining module 101 may obtain information on whether the power supply circuit of the compressor 200 is powered on from the power detecting circuit 1013. In a further embodiment, the phase detecting circuit 1012 and the power detecting circuit 1013 may be integrated as a detecting circuit of a power supply circuit, and the detecting circuit may obtain, via an electrical connection with the power supply circuit, phase information and information on whether power is supplied.

Figure 2:
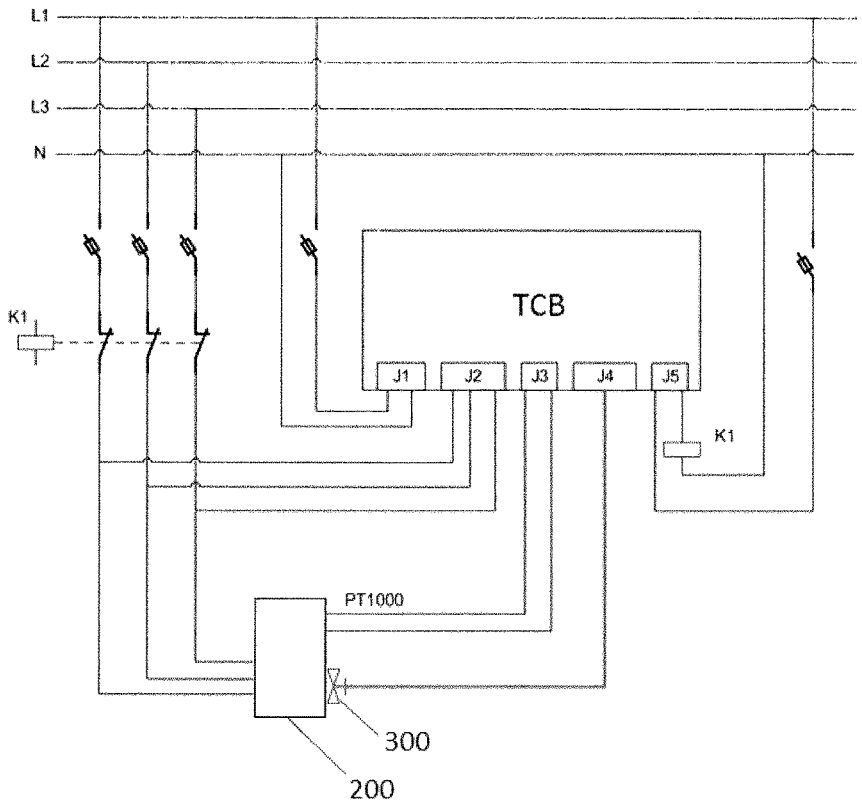
FIG. 2 is a schematic diagram of a control loop for a compressor according to an embodiment of the present disclosure.

FIG. 2 is a schematic diagram of a control loop for a compressor according to an embodiment of the present disclosure. As shown in FIG. 2, L1, L2 and L3 represent three-phase live lines of the power supply circuit of the compressor 200, and N represents the null line. The controlling module 102 in the controller 100 is integrated with the obtaining module 101 in the controller 100 as a TCB (short for Trusted Computing Base, which refers to the entirety of protection devices in a computer, including hardware, firmware, software, and a combination entity responsible for executing security policies). The controlling module 102 may be implemented by, for example, an MCU (Micro Control Unit). The liquid injection valve 300 can be implemented by a step motor valve.

There may be five function modules J1~J5 in the TCB. Specifically, the module J1 is connected to the three-phase live lines and null line of the power supply circuit for supplying power to the TCB. The module J2 integrates the functions of the phase detecting circuit 1012 and the power detecting circuit 1013, and is connected to the three-phase live lines of the power supply circuit of the compressor 200 to determine whether the power supply circuit is in a phase loss state or phase reverse state while determining whether the power supply circuit is powered on. The module J3 is connected to a platinum thermal resistance (PT1000) disposed at the discharge position of the compressor 200 to implement the temperature detecting circuit 1011. The module J5 is connected to a contactor K1 for communicating control commands from the controlling module 102 to the contactor K1. The contact of the contactor K1 (for example, the normally closed contact) is simultaneously connected to the power supply circuit of the compressor 200, and the controlling module 102 in the TCB may perform the protection action of powering off the compressor 200 through the contactor K1.

It should be understood that although specific embodiments of some of the devices, modules, or circuits in the controller 100 have been provided in the above description, those skilled in the art may actually select different types or models of electronic devices to implement the devices according to practical scenario requirements. The present disclosure does not limit the specific implementations of these devices, modules or circuits.

Figure 3:
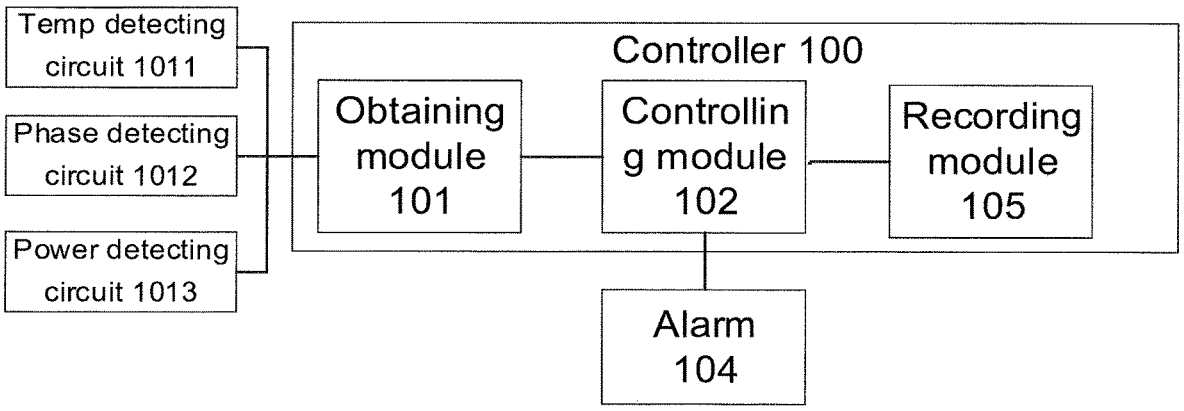
FIG. 3 is a schematic structural diagram of a controller for a compressor according to another embodiment of the present disclosure.

FIG. 3 is a schematic structural diagram of a controller for a compressor according to another embodiment of the present disclosure. As shown in FIG. 3, the controlling module 102 may be further configured to control an alarm 104 to raise an alarm if one of the at least one operation state parameter meets the protection action condition, and/or configured to record the at least one operation state parameter if one of the at least one operation state parameter meets the protection action condition. In an embodiment, the recording action can be implemented by a recording module 105 connected to the controlling module 102. Once the operation state parameter of the compressor 200 is abnormal (for example, the foregoing power supply abnormality and/or the discharge temperature abnormality), an alarm signal may be issued by the alarm 104 in time to remind the user or the operator to make check manually, thereby further improving the reliability of products.

The recording module 105 connected to the control module 102 may also be used to record one or more types of the following information: the discharge temperature of the compressor 200, the open degree of the liquid injection valve 300, whether the power supply circuit of the compressor 200 is powered on, whether the power supply circuit of the compressor 200 is in a phase loss state or phase reverse state, and whether the discharge temperature exceeds a first threshold value. Those information record can enable tracing the cause of equipment failures, and thus can further improve modules in failure so as to improve reliability of products.

It should be understood that the alarm 104 and the recording module 105 need not necessarily coexist in a control system although both the alarm 104 and the recording module 105 are included in the embodiment shown in FIG. 3. The control system may include only the alarm 104 or the recording module 105 according to the design requirements of the specific scenario, which is not limited in the present disclosure.

Figure 4:
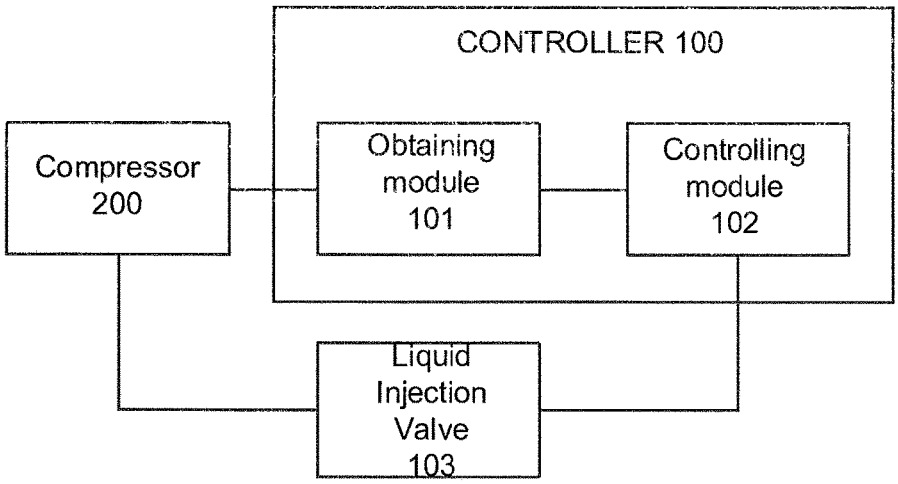
FIG. 4 is a schematic structural view of a compressor assembly according to an embodiment of the present disclosure.

FIG. 4 is a schematic structural view of a compressor assembly according to an embodiment of the present disclosure. As shown in FIG. 4, the compressor assembly includes a compressor 200, a liquid injection valve 300 for regulating the flow of the fluid injected to the compressor 200, and the controller 100 in any of the above embodiments. By the controller 100 provided by the embodiment of the present disclosure, the controlling module 102 in the controller 100 can directly and actively control the liquid injection valve 300 to stop when one of the at least one operation state parameter acquired meets a protection action condition and thus the liquid injection need be stopped. Compared with the prior art which requires a solenoid valve disposed at the front end of the liquid injection valve to passively know whether the compressor 200 is powered, the controlling module 102 can actively control the protection action of the liquid injection valve 300. The liquid injection valve 300 can thus be prevented in a reliable and efficient way from being still in the operating state even if the compressor is stopped, which improves the safety and operation efficiency of the entire control system. In summary, compared to the prior art which requires an additional solenoid valve to perform the protection action of the liquid injection valve, embodiments of the present disclosure omit the solenoid valve at the front end of the liquid injection valve, thereby simplifying the system structure and reducing the occupation space and product costs.

Figure 5:
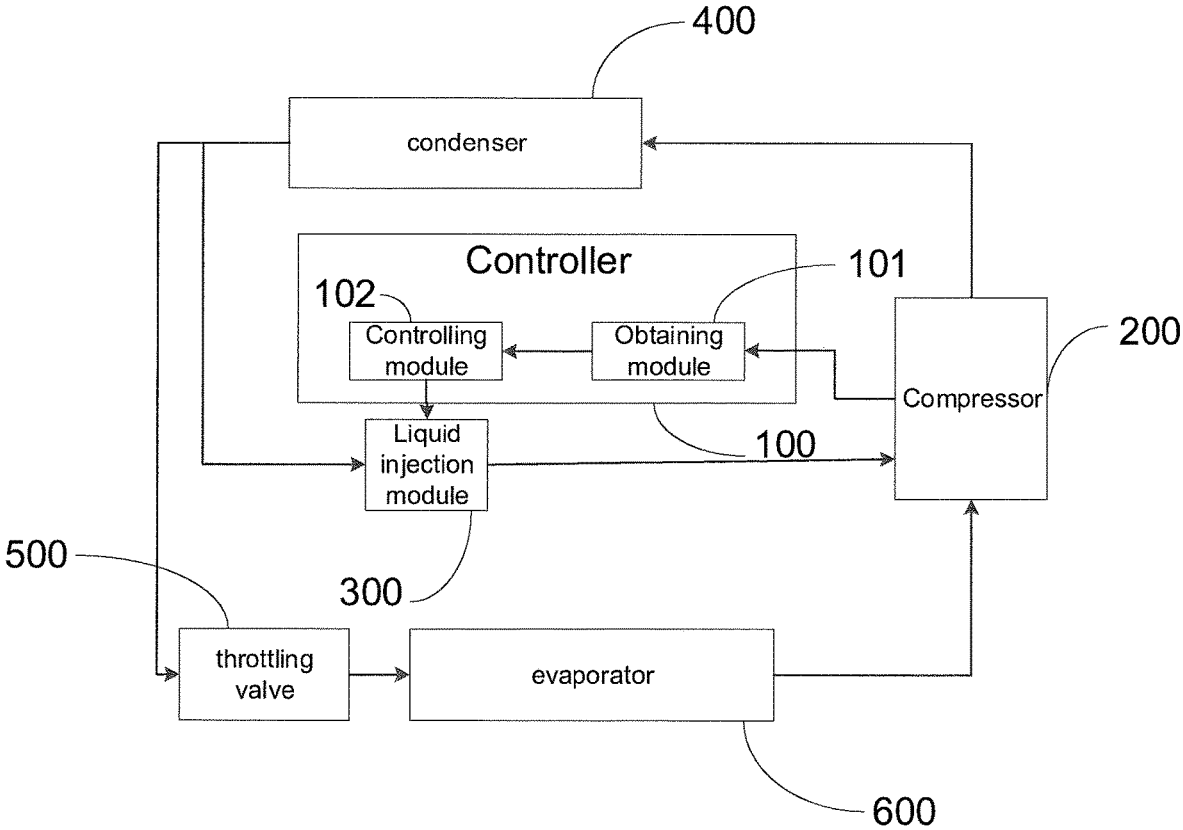
FIG. 5 is a schematic structural diagram of a refrigeration system according to an embodiment of the present disclosure.

FIG. 5 is a schematic structural diagram of a refrigeration system according to an embodiment of the present disclosure. As shown in FIG. 5, the refrigeration system includes a compressor 200 as shown in the embodiment of FIG. 4, a condenser 400, a throttling device 500, and an evaporator 600. Specifically, an inlet of the condenser 400 is connected to a refrigerant liquid outlet of the compressor 200, and an inlet of the throttling device 500 is connected to an outlet of the condenser 400. An inlet of the evaporator 600 is connected to an outlet of the throttling device 500. An outlet of the evaporator 600 is connected to a refrigerant liquid inlet of the compressor 200. The refrigerant fluid is compressed in the compressor 200 and supplied to the condenser 400, which is in turns depressurized by the throttle device 500 and supplied to the evaporator 600, and then returned to the compressor 200 from the evaporator 600.

By the controller 100 for the compressor 200 in accordance with the embodiment of the present disclosure, the controlling module 102 in the controller 100 can directly and actively control, if one of the acquired operation state parameters meets the protection action condition and thus the liquid injection need be stopped, the liquid injection valve 300 to stop so that the liquid injection valve 300 can be prevented in a reliable and efficient way from being still in the operating state even if the compressor 200 is stopped. Thereby, the safety and operating efficiency of the entire control system is improved. In addition, the embodiment of the present disclosure can omit an additional solenoid valve, thereby simplifying the system structure and reducing the occupation space and product costs.

Figure 6:
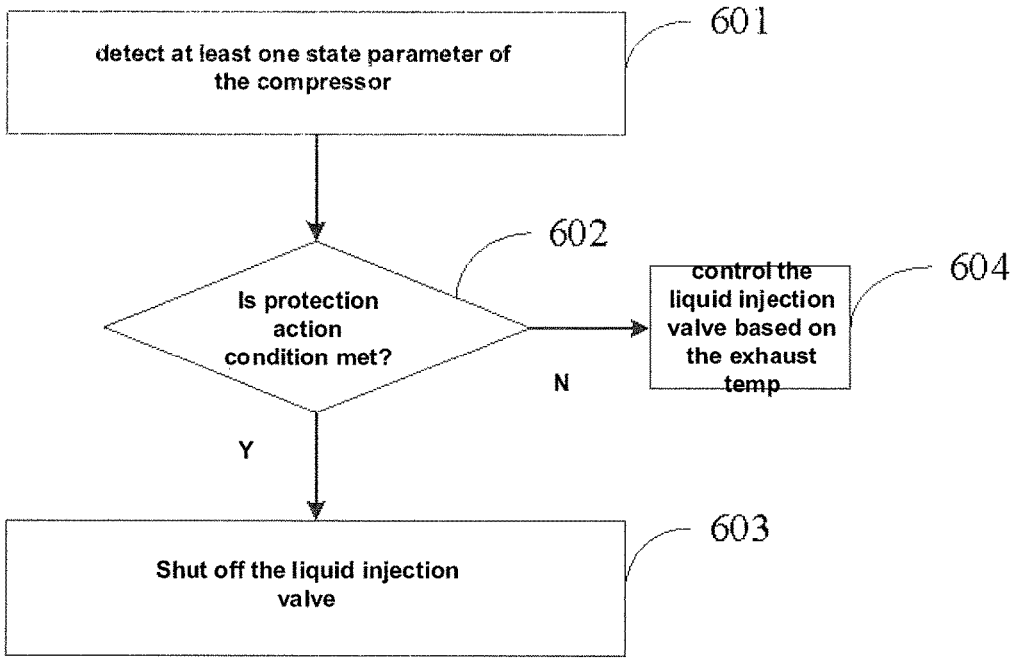
FIG. 6 is a schematic flow chart of a method for controlling liquid injection in a compressor according to an embodiment of the present disclosure.

FIG. 6 is a schematic flow chart of a method for controlling liquid injection for a compressor according to an embodiment of the present disclosure. As shown in FIG. 6, the method includes the following steps.

In Step 601, at least one operation state parameter of the compressor is obtained. The operation state parameter indicates state of the compressor.

In Step 602, it is determined whether one of the at least one operation state parameter meets a protection action condition. For example, the protection action condition may be an abnormality in one of the at least one operation state parameter.

In Step 603, shutting off a liquid injection valve if one of the at least one operation state parameter of the compressor meets a protection action condition. The liquid injection valve is configured to regulate the flow of fluid injected into the compressor.

In an embodiment of the disclosure, the above described method for controlling liquid injection is implemented in a single controller. Thus, by using the method for controlling liquid injection provided by the embodiment of the disclosure, the controller can directly and actively control the liquid injection valve to stop liquid injection if one of the obtained operation state parameter meets the protection action condition and the liquid injection need be stopped.

In an embodiment of the disclosure, the at least one operation state parameter acquired includes at least discharge temperature of the compressor. As shown in FIG. 6, the method further includes Step 604 of controlling the liquid injection valve based on the discharge temperature if the at least one operation state parameter of the compressor does not meet the protection action condition. It can be seen that since the acquired operation state parameter includes the discharge temperature, the controller can control the liquid injection valve according to the discharge temperature if the protection action is not required. That is, the controller has both liquid injection control function and protection control function.

In an embodiment, it may be determined whether the protection action is required by determining whether the acquired discharge temperature is above a first threshold value. If the discharge temperature is above the first threshold value, it means that the discharge temperature of the compressor is too high and even the liquid injection valve cannot reduce the discharge temperature of the compressor. In order to avoid damage to the compressor, it is necessary to perform protection action, e.g., powering off the compressor, to protect the compressor. Meanwhile, the liquid injection valve is shut off in order to prevent the liquid injection valve from being in a liquid injection state when the compressor is stopped.

In a further embodiment, if the discharge temperature of the compressor does not exceed the first threshold value, it means that the discharge temperature of the compressor does not reach an alarm condition for the operation of the compressor. The discharge temperature of the compressor can be controlled by the cooling fluid injected from the liquid injection valve. If the discharge temperature of the compressor is above the second threshold value and below the first threshold value, an open degree of the liquid injection valve can be adjusted according to the discharge temperature of the compressor and a second threshold value. The specific control method for the open degree of the liquid injection valve can be realized by, for example, PI or PID (proportional-integral or proportional-integral-derivative controller), but the specific control implementation manner of the open degree of the liquid injection valve is not limited in the present disclosure.

It should be understood that the first threshold value is a temperature threshold value where the compressor may still operate normally and the second threshold value is a predefined discharge temperature where liquid injection is needed for the compressor. When the discharge temperature of the compressor is above the first threshold value, it means that the compressor cannot operate normally. When the discharge temperature of the compressor is above the second threshold value and below the first threshold value, the compressor may still operate normally but liquid injection is needed for the compressor so as to avoid the discharge temperature from becoming too high. However, the specific values of the first and second threshold values can be set or adjusted by a designer or an operator according to a practical scenario. The specific values of the first and second threshold values are not limited in the present disclosure.

In an embodiment, the at least one operation state parameter may further include phase information of a power supply circuit of the compressor. It may be determined whether the protection action is needed according to the phase information. If the power supply circuit of the compressor is in a phase loss state or phase reverse state, it means that there is a malfunction or failure in the power supply circuit of the compressor, and there may be damage if the compressor keeps active. Thus, it is necessary to perform a protection action to power off the compressor so that the compressor stops operation. Meanwhile, the liquid injection valve is to be shut off so as to prevent it from being in the injection state even when the compressor stops operation. If the power supply circuit is not in a phase loss state or phase reverse state, it means that the power supply circuit of the compressor operates normally.

In an embodiment of the present disclosure, the discharge temperature and phase information of the compressor can be used as the operation state parameters for determining whether the protection action condition is met. In a further embodiment, a power supply abnormality in the compressor may cause significantly damage to the compressor in a short time, while the discharge temperature abnormality does not affect the compressor so fast. Thereby, the protection action according to the power supply abnormality has a higher priority than the protection according to the discharge temperature abnormality. In other words, it is firstly determined whether the power supply circuit is in a phase loss state or phase reverse state according to the phase information acquired by a phase detecting circuit. If the power supply circuit is in a phase loss state or phase reverse state, the liquid injection valve is shut off and the compressor is powered off. If the power supply circuit is not in a phase loss state or phase reverse state, it is further determined whether the acquired discharge temperature exceeds a first threshold. When it is further determined that the discharge temperature exceeds the first threshold, the liquid injection valve is shut off and the compressor is powered off.

In an embodiment of the present disclosure, the at least one operation state parameter may further include information on whether the compressor is powered on. For example, it can be determined whether the compressor is powered on by determining whether the power supply circuit of the compressor is powered on or by determining whether the running speed of the compressor is zero. Since the compressor is inactive when it is not powered on, it is not necessary to determine whether the discharge temperature is too high or whether the phase information is abnormal. Thus, it can be determined whether the power supply circuit of the compressor is powered on prior to determining whether one of the at least one operation state parameter meets the protection action condition. If the power supply circuit is powered off, it means that the compressor is not powered on and does not operate, and it may cause damage to the compressor if the liquid injection valve continues operating. Therefore, it is necessary to shut off the liquid injection valve. Since the compressor is inactive when it is not powered on, it is not necessary to determine whether the discharge temperature is too high or whether the phase information is abnormal, and thus the foregoing determination process based on the discharge temperature and phase information is no longer required. On the other hand, if the power supply circuit is powered on, it indicates that the compressor is in a normal power-on state at this moment, and further determination is made to determine whether one of the at least one operation state parameter meets the protection action condition, and the protection action is performed when one of the at least one operating state parameter meets the protection action condition. When none of the at least one operation state parameter meets the protection action condition, open degree of the liquid injection valve is controlled according to the discharge temperature.

Figure 7:
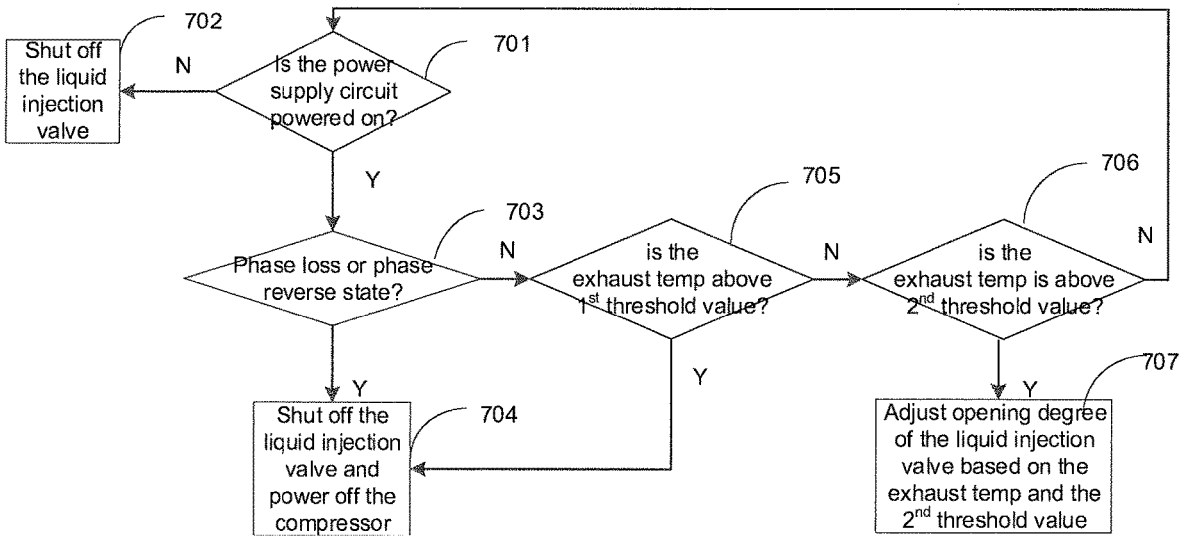
FIG. 7 is a schematic flow chart of a method for controlling liquid injection in a compressor according to another embodiment of the present disclosure.

FIG. 7 is a schematic flow chart of a method for controlling liquid injection for a compressor according to another embodiment of the present disclosure. The operation state parameters obtained in the method include phase information of a power supply circuit of the compressor, an discharge temperature of the compressor, and information on whether the power supply circuit of the compressor is powered on. As shown in FIG. 7, the method includes the following steps.

In Step 701, it is determined whether the compressor is powered on, such as whether the power supply circuit of the compressor is powered on. If no, Step 702 is proceeded; if yes, Step 703 is proceeded.

In Step 702, the liquid injection valve is shut off.

In Step 703, it is determined whether the power supply circuit of the compressor is in a phase loss state or phase reverse state. If yes, Step 704 is proceeded; if no, Step 705 is proceeded.

In Step 704, the liquid injection valve is shut off and the compressor is powered off.

In Step 705, it is determined whether the discharge temperature exceeds a first threshold value. If yes, Step 704; if no, Step 706.

In Step 706, it is determined whether the acquired discharge temperature exceeds a second threshold value. If yes, Step 707 is proceeded; if no, Step 701 is proceeded.

In Step 707, the open degree of the liquid injection valve is adjusted according to the discharge temperature of the compressor and the second threshold value.

It should be understood that each of the steps provided by the above method embodiments may correspond to the functions implemented by one of devices, modules or circuits in the aforementioned controller. Therefore, the operations and features described in the foregoing controller may also be applicable to each step of the foregoing embodiment, and the repeated content will not be described herein again.

An embodiment of the present disclosure further provides a computer device including a memory, a processor, and a computer program stored on the memory and executed by the processor, wherein the processor executes the computer program to implement the steps of the method as described in any of the preceding embodiments.

An embodiment of the present disclosure further provides a computer readable storage medium storing a computer program, when executed by a processor, implements the steps of the method as described in any of the preceding embodiments. The computer storage medium can be any tangible medium such as a floppy disk, CD-ROM, DVD, hard drive, or even Internet media.

It should be understood that the method or apparatus of the embodiments of the present disclosure may be implemented in software, hardware, or a combination of software and hardware although the computer program product is described as an embodiment of the present disclosure described above. The hardware may be implemented by dedicated logic; the software may be stored in a memory and executed by a suitable instruction execution system, such as a microprocessor or dedicated design hardware. One of ordinary skill in the art will appreciate that the methods and apparatus described above can be implemented using computer-executable instructions and/or embodied in processor control codes. Such codes are provided on a carrier medium such as a magnetic disk, CD or DVD-ROM, a programmable memory such as a read only memory (firmware) or a data carrier such as an optical or electronic signal carrier. The method and apparatus of the present disclosure may be implemented by hardware circuits such as very large scale integrated circuits or gate arrays, semiconductors such as logic chips, transistors, etc., or programmable hardware devices such as field programmable gate arrays, programmable logic devices, etc., and it can also be implemented by software executed by various types of processors or by a combination of the above-described hardware circuits and software such as firmware.

It will be understood that, although several modules or units of the device are referred to in the above detailed description, this is merely exemplary and not mandatory. In fact, the features and functions of the two or more modules/units described above may be implemented in one module/unit according to an exemplary embodiment of the present disclosure, and conversely, the features and functions of one module/unit described above may also be further divided into multiple modules/units. Moreover, some of the modules/units described above may be omitted in certain application scenarios.

It should be understood that the description is only illustrative of some essential techniques and features, and that some features that can be implemented by those skilled in the art are not described.

The above are only the preferred embodiments of the present disclosure, and are not intended to limit the present disclosure. Any modifications, equivalents, etc. within the spirit and scope of the present disclosure are intended to be included in the scope of the present disclosure.

What is claimed is:

1. A controller for a compressor, comprising:

an obtaining module configured to obtain at least one operation state parameter of the compressor; and a controlling module configured to shut off a liquid injection valve if one of the at least one operation state parameter of the compressor meets a protection action condition, wherein the liquid injection valve is configured to regulate flow of liquid injected into the compressor, wherein the protection action condition refers to a condition wherein an action is required in order to protect the compressor, and wherein the liquid injection valve excludes a solenoid valve;

wherein the at least one operation state parameter comprises a discharge temperature of the compressor, and wherein the controlling module is further configured to control, if the at least one operation state parameter of the compressor does not meet the protection action condition, the liquid injection valve according to the discharge temperature of the compressor; and wherein the controlling module is configured to control the liquid injection valve based on the discharge temperature by adjusting an open degree of the liquid injection valve, the open degree being variable such that there is more than one open position open degree.

2. The controller of claim 1, wherein the controlling module is configured to shut off the liquid injection valve and power off the compressor if the discharge temperature of the compressor is above a first threshold value.

3. The controller of claim 2, wherein the controlling module is configured to adjust, if the discharge temperature of the compressor is above a second threshold value and below the first threshold value, the open degree of the liquid injection valve according to the discharge temperature of the compressor and the second threshold value.

4. The controller of claim 1, wherein the at least one operation state parameter comprises phase information of a power supply circuit of the compressor, and wherein the controlling module is configured to shut off the liquid injection valve and power off the compressor if the power supply circuit is in a phase loss state or phase reverse state.

5. The controller of claim 1, wherein the at least one operation state parameter comprises information on whether the compressor is powered on, and wherein the controlling module is configured to shut off the liquid injection valve if the compressor is not powered on.

6. The controller of claim 1, wherein the controlling module is further configured to control an alarm to raise an alarm if one of the at least one operation state parameter meets the protection action condition, and/or to record the at least one operation state parameter if one of the at least one operation state parameter meets the protection action condition.

7. The controller of claim 1, wherein the controlling module is further configured to record one or more of: a discharge temperature of the compressor, an open degree of the liquid injection valve, information on whether the compressor is powered on, whether a power supply circuit of the compressor is in a phase loss state or phase reverse state, and whether the discharge temperature exceeds a first threshold value.

8. A method for controlling liquid injection for a compressor by the controller of claim 1, comprising:

obtaining at least one operation state parameter of the compressor, and shutting off the liquid injection valve if one of the at least one operation state parameter of the compressor meets a protection action condition;

wherein the liquid injection valve is configured to regulate the flow of liquid injected into the compressor;

wherein the at least one operation state parameter comprises a discharge temperature of the compressor, and wherein the method further comprises: controlling, if the at least one operation state parameter of the compressor does not meet the protection action condition, the liquid injection valve according to the discharge temperature of the compressor.

9. The method of claim 8, wherein said shutting off a liquid injection valve if one of the at least one operation state parameter of the compressor meets a protection action condition comprises: shutting off the liquid injection valve and powering off the compressor if the discharge temperature of the compressor is above a first threshold value.

10. The method of claim 9, wherein said controlling a liquid injection valve according to the discharge temperature of the compressor if one of the at least one operation state parameter of the compressor meets a protection action condition comprises: adjusting, if the discharge temperature of the compressor is above a second threshold value and below the first threshold value, an open degree of the liquid injection valve according to the discharge temperature of the compressor and the second threshold value.

11. The method of claim 8, wherein the at least one operation state parameter comprises phase information of a power supply circuit of the compressor, and wherein said shutting off a liquid injection valve if one of the at least one operation state parameter of the compressor meets a protection action condition comprises: shutting off the liquid injection valve and powering off the compressor if the power supply circuit is in a phase loss state or phase reverse state.

12. The method of claim 8, wherein the at least one operation state parameter comprises information on whether the compressor is powered on, and wherein said shutting off a liquid injection valve if one of the at least one operation state parameter of the compressor meets a protection action condition comprises: shutting off the liquid injection valve if the compressor is not powered on.

13. The method of claim 8, further comprising:

controlling an alarm to raise an alarm if one of the at least one operation state parameter meets the protection action condition, and/or recording the at least one operation state parameter if one of the at least one operation state parameter meets the protection action condition.

14. The method of claim 8, further comprising: recording one or more of: a discharge temperature of the compressor, an open degree of the liquid injection valve, information on whether the compressor is powered on, whether a power supply circuit of the compressor is in a phase loss state or phase reverse state, and whether the discharge temperature exceeds a first threshold value.

15. A compressor assembly, comprising:

the compressor;

the liquid injection valve configured to regulate the flow of liquid injected into the compressor; and the controller of claim 1, configured to control the liquid injection valve and/or the compressor.

16. A refrigeration system, comprising:

the compressor assembly of claim 15;

a condenser, an inlet of the condenser being connected to a refrigerant fluid outlet of the compressor;

a throttle device, an inlet of the throttling device being connected to an outlet of the condenser;

an evaporator, an inlet of the evaporator being connected to an outlet of the throttling device, an outlet of the evaporator being connected to a refrigerant fluid inlet of the compressor; and the liquid injection valve is configured at a pipeline between the outlet of the condenser and the compressor;

wherein the refrigeration system excludes any additional solenoid valve connected at the front end of the liquid injection valve.

17. The controller of claim 1, wherein the liquid injection valve is a step-motor valve.

18. The controller of claim 1, wherein the controlling module and the obtaining module are integrated in the controller as a Trusted Computing Base (TCB);

wherein the TCB comprises:

a first function module J1, connected to three-phase live lines and null line of a power supply circuit for supplying power to the TCB;

a third function module J3, connected to a platinum thermal resistance disposed at a discharge position of the compressor and configured to detect the discharge temperature of the compressor; and a fourth module J4, connected to the liquid injection valve and configured to shut off the liquid injection valve if one of the at least one operation state parameter of the compressor meets the protection action condition, and to control, if the at least one operation state parameter of the compressor does not meet the protection action condition, the liquid injection valve according to the discharge temperature of the compressor to regulate the flow of liquid injected into the compressor.

19. The controller of claim 18, wherein the TCB further comprises a second module J2 integrating a phase detecting circuit and a power detecting circuit, and is connected to the three-phase live lines of the power supply circuit of the compressor to determine whether the power supply circuit is in a phase loss state or phase reverse state while determining whether the power supply circuit is powered on.

20. The controller of claim 18, wherein the TCB further comprises a fifth module J5 connected to a contactor K1 for communicating a control command from the controlling module to the contactor K1, and wherein contact of the contactor K1 is connected to the power supply circuit of the compressor, and the controlling module in the TCB is configured to perform a protection action of powering off the compressor through the contactor K1.

* * * * *